US007163915B2

(12) United States Patent
Gernon et al.

(10) Patent No.: US 7,163,915 B2
(45) Date of Patent: Jan. 16, 2007

(54) AQUEOUS SOLUTIONS CONTAINING DITHIONIC ACID AND/OR METAL DITHIONATE FOR METAL FINISHING

(75) Inventors: Michael D. Gernon, Upper Providence, PA (US); Sandra L. Bodar, Coulommiers (FR)

(73) Assignee: Arkema Inc., Philadelphia, PA (US)

( * ) Notice: Subject to any disclaimer, the term of this patent is extended or adjusted under 35 U.S.C. 154(b) by 421 days.

(21) Appl. No.: 10/723,921

(22) Filed: Nov. 26, 2003

(65) Prior Publication Data

US 2004/0082489 A1 Apr. 29, 2004

Related U.S. Application Data

(62) Division of application No. 09/791,224, filed on Feb. 22, 2001, now abandoned.

(60) Provisional application No. 60/186,097, filed on Mar. 1, 2000.

(51) Int. Cl.
*C25D 5/02* (2006.01)

(52) U.S. Cl. ..... 510/245; 205/305; 106/14.44

(58) Field of Classification Search ..... None
See application file for complete search history.

(56) References Cited

U.S. PATENT DOCUMENTS

| | | | | |
|---|---|---|---|---|
| 2,717,870 | A * | 9/1955 | Dean | 205/262 |
| 4,130,431 | A * | 12/1978 | Kogure | 106/14.33 |
| 5,441,665 | A * | 8/1995 | Massaioli | 510/169 |
| 5,547,559 | A * | 8/1996 | Kukanskis et al. | 205/125 |
| 5,718,818 | A * | 2/1998 | Martyak et al. | 205/305 |
| 5,747,635 | A * | 5/1998 | Kroner et al. | 528/328 |
| 5,788,822 | A * | 8/1998 | Martyak et al. | 205/313 |
| 6,585,812 | B1 * | 7/2003 | Martyak et al. | 106/14.44 |

FOREIGN PATENT DOCUMENTS

| | | |
|---|---|---|
| DE | 19639174 | 4/1997 |
| JP | 08269726 A | 10/1996 |
| JP | 08269727 A | 10/1996 |

* cited by examiner

*Primary Examiner*—Gregory Webb
(74) *Attorney, Agent, or Firm*—Steven D. Boyd

(57) ABSTRACT

This invention relates to solutions of dithionic acid and/or dithionate salts which use in metal finishing processes such those used for the cleaning, activating, electroplating, electroless plating, conversion coating and/or other pre-treatment or post-treatment of a metallic surface. In particular the solutions are a useful electrolyte for the electroplating of metallic coatings, especially, Sn, Cu, Ni, Zn and precious metals, onto metal or plastic substrates and/or other surfaces.

16 Claims, No Drawings

AQUEOUS SOLUTIONS CONTAINING DITHIONIC ACID AND/OR METAL DITHIONATE FOR METAL FINISHING

REFERENCE TO RELATED APPLICATION

This application is a divisional of application Ser. No. 09/791,224, filed Feb. 22, 2001, now abandoned, which claims the benefit of U.S. Provisional Application Ser. No. 60/186,097, filed Mar. 1, 2000.

BACKGROUND OF THE INVENTION

1. Field of the Invention

This invention relates to solutions useful in metal finishing processes. In particular it relates to solutions containing dithionic acid and/or dithionate salts.

2. Description of the Prior Art

Known plating electrolytes include, for instance, alkaline cyanide, acidic sulfate, acidic phosphate, acidic fluoborate and acidic methanesulfonate systems. These various electrolytes are selected by industrial practitioners of metal finishing based on the relative advantages they offer for performance, quality and environmental compatibility.

The industry is constantly seeking new and improved electrolyte systems for the finishing of metal substrates which allow for favorable differentiation of plating processes relating, for instance, to electroplating speed, performance and electrodeposit quality.

Kubo, M.; Kamitamari, T.; Hotsuta, T.; Masamoto, H.; Jpn. Kokai Tokkyo Koho JP 08269727 A2, Oct. 15, 1996, assigned to Uemura Kogyo, discloses the use of an inorganic sulfur compound selected from thiosulfate, polythhionate, dithionite, sulfite and dithionate at an amount of 0.01 to 10 mmol/L as an additive in an electroless palladium coating bath containing a palladium salt, a reductant selected from $H_3PO_2$ and its salts, $H_3PO_3$ and its salts, hydroborides, and amine borane, and complexing agent selected from $NH_3$ and amines.

Uchida, H et al, Kokai, Tokkyo Koho JP 08269726 A2 and Uchida, H et al, German Offen. DE 19639174 A1 both disclose a solution for electroless coating of nickel. The solution contains a water soluble nickel salt, a reducing agent, a complexing agent and a compound having S—S bonds, such as, thiosulfate, dithionate, dithionite, and polythionate.

SUMMARY OF THE INVENTION

One embodiment of the invention is an aqueous solution of dithionic acid and/or dithionate salts which serves as a useful electrolyte for the electroplating of metallic coatings, especially, Sn, Cu, Ni, Zn and precious metals, onto metal or plastic substrates and/or other surfaces.

Another embodiment is a metal finishing solution composition which contains free dithionic acid.

Another embodiment is an electroplating solution composition which contains free dithionic acid.

Another embodiment is an electroplating solution composition which contains metal or ammonium dithionate salts.

Another embodiment is a surface cleaning solution composition which contains free dithionic acid.

Another embodiment is a surface cleaning solution composition for a substrate, other than copper, which contains metal or ammonium dithionate salts.

Another embodiment is an aqueous solution of ammonium, IA metal and/or IIA metal dithionate salts for cleaning and activating metal, plastic and/or other surfaces.

Another embodiment is an electroless or immersion plating composition which contains free dithionic acid.

Another embodiment is an electroless or immersion plating composition, other than one for nickel or palladium, which contains dissolved metal or ammonium dithionate salts.

Another embodiment is an electroless or immersion plating composition for nickel or palladium, which contains dissolved nickel dithionate, palladium dithionate, other metal dithionate or ammonium dithionate salts at concentrations greater than 0.1 M.

Another embodiment is the use of an solution containing dissolved metal or ammonium dithionate as a rust removing agent.

Another embodiment is the use of compositions of the invention as an electroless or immersion plating solution in an electroless or immersion tin plating system.

Another embodiment is an electroplating process employing a composition of the invention.

Another embodiment is a metal, semiconductor or plastic surface treatment process employing a composition of the invention.

Another embodiment is a metal finishing process employing a composition of the invention.

DETAILED DESCRIPTION OF THE INVENTION

The description which follows sets forth additional features and advantages of the invention which, in part, will become apparent from the description or learned by practice of the invention. The skilled artisan will realize the objectives and other advantages of the invention obtained by process and compositions of matter particularly pointed out in the written description and claims hereof.

Dithionic acid has the molecular formula $H_2S_2O_6$ (CAS Registry # 14970-71-9). Dithionic acid and salts derived from dithionic acid are the basis of the compositions and processes of the present invention.

Alkaline, neutral and acidic dithionate based electrolytes offer numerous advantages with respect to power consumption, process performance and quality for a number of industrially important metal finishing processes.

A Electrolyte@ as used herein means any conducting aqueous or mixed aqueous solution which can be used as the basis for a formulated metal finishing product.

A Metal finishing@ as used herein is meant to encompass all processes used for the cleaning, activating, electroplating, electroless plating, conversion coating and/or other pre-treatment or post-treatment of a metallic surface, semiconductor, glass or hard plastic.

The differentiation between an additive and an electrolyte component as based on concentration is not definite. An additive is something which is added to enhance certain aspects of the surface (cleaned, electroplated or whatever) quality. An electrolyte component is something which provides for solubility, conductivity, process efficiency, deposit quality and other things.

The following ranges are indicated:

For Electroplating, Electroless Plating, Immersion Plating, one can use dithionic acid up to 60% by weight, preferred is 0.1% to 25% by weight, more preferred is 1% to 18% by weight. Aqueous dithionic acid solutions become less stable as the acidity of the solution is increased. The preferred range for dithionic acid is up to 25% by weight (stable in this range), but higher levels are occasionally useful. The instability of the acid at higher free acid levels is something that needs to be balanced against its performance at higher acid levels. Metal dithionates can be used up to their saturation solubility, preferred is 0.01M to 2M in metal, more preferred is 0.1M to 1M in metal. The metals employed may be the metals plated and/or they may be other metals used to provide peripheral benefits like conductivity. A generally preferred range for the metal dithionates added for peripheral benefits is from 0.001M to 5M in metal, preferred is 0.01M to 2M in metal, more preferred is 0.1M to 1M in metal.

For Surface Activating, Cleaning, Pre-Treatment, Post-Treatment, Rust Removal, one can use dithionic acid up to 60% by weight, preferred is 0.1% to 25% by weight, more preferred is 1% to 18% by weight. Aqueous dithionic acid solutions become less stable as the acidity of the solution is increased. The preferred range for dithionic acid is up to 25% by weight (stable in this range), but higher levels are occasionally useful. The instability of the acid at higher free acid levels is something that needs to be balanced against its performance at higher acid levels. Metals may be added to the surface treatment solution as desired. Metal dithionates can be used up to their saturation solubility. A concentration range up to to 2M would generally be more preferred, most preferred is 0.1M to 1M in metal.

This invention is best practiced by formulating aqueous electroplating solutions, metal cleaning solutions, activating solutions, electroless plating solutions, immersion plating solutions and/or other metal finishing solutions with added dithionic acid, metal dithionate and/or ammonium dithionate salts.

This dithionic acid and/or these dithionate salts can be added in small amounts to function as additives, or this dithionic acid and/or these dithionate salts can be added in larger amounts to serve as a source of the metal(s) to be electroplated and/or as a major part of the conductive electrolyte.

A typical electroplating solution is composed of a solvent, an electrolyte system, a source(s) of the metal(s) to be electrodeposited and one or more functional additives. The solvent is usually water or water mixed with a miscible solvent. The electrolyte system can be acidic, neutral or alkaline.

The electrolyte system serves to create an ionically conductive solution, to solubilize the metal salt source of the metal to be electroplated and to, in general, create a solution which allows for adequate performance.

The metal salt source of the metal to be electroplated has an obvious function.

Additives are used mostly to improve the quality of the electrodeposited metal(s) through specific surface effects. For instance, surface tension lowering additives are used to, among other things, allow for the more efficient ejection of gas bubbles from the surface being electroplated. Such gas bubbles, if they are not properly handled, can cause pits in the electroplated coating.

In this invention, dithionic acid and/or metal dithionates, such as the sodium, potassium, calcium, copper, zinc, nickel, tin, lead, ammonium and/or other metal dithionates, are added to electroplating formulations as a means of improving the performance of these formulations.

Cleaning and activation solutions do not require a source of metal ions for deposition, but such systems do require an optimized electrolyte composition. In this invention, dithionic acid and/or metal dithionates, such as the sodium, potassium, calcium, copper, zinc, nickel, tin, ammonium and/or other metal dithionates, are added to the cleaning and/or activating solutions as a means of improving the performance of these solutions.

Electroless plating solutions are similar to electroplating solutions except that a chemical reducing agent is used in place of cathodic current for the deposition of the metal layer(s). In this invention, dithionic acid and/or metal dithionates, such as the sodium, potassium, calcium, copper, zinc, nickel, tin, lead, ammonium and/or other metal dithionate salts, are added to electroless plating formulations as a means of improving the performance of these formualtions.

Immersion plating solutions are similar to electroplating solutions except that oxidative dissolution of an active substrate metal replaces cathodic current as the means for the deposition of a more nobel metal layer(s). In this invention, metal dithionates, such as the sodium, potassium, calcium, copper, zinc, nickel, tin, gold, silver, PGM, ammonium and/or other metal dithionates, are added to immersion plating formulations as a means of improving the performance of these formualtions.

Some examples of the compositions covered by this invention include the following:

1) Acid Sn, Sn/Pb or Sn alloy electroplating systems based on electrolytes composed of stannous dithionate, lead dithionate, dithionic acid and/or other metal dithionate salts.
2) Acid Sn, Sn/Pb or Sn alloy electroplating systems based on electrolytes composed of stannous dithionate, lead dithionate, dithionic acid and/or other metal dithionate salts and/or other appropriate aqueous acids (e.g., sulfuric acid, methanesulfonic acid).
3) Acid Sn, Sn/Pb or Sn alloy electroplating systems based on mixed electrolytes which contain some dithionic acid, stannous dithionate, lead dithionate and/or other metal dithionate salts.
4) Acid Sn, Sn/Pb or Sn alloy electroplating systems based on electrolytes which contain stannous dithionate, lead dithionate, dithionic acid and/or other metal dithionate salts as additives.
5) Aqueous solutions containing dithionic acid and/or metal dithionate salts which are used to clean or activate substrates prior to other finishing steps.
6) Aqueous solutions containing dithionic acid and/or metal dithionate salts which are used to clean, activate and/or remove rust from ferrous based substrates.
7) Nickel electroplating systems based on electrolytes containing dithionic acid, nickel dithionate and/or other metal dithionate salts.
8) Copper electroplating systems based on electrolytes containing dithionic acid, cupric dithionate and/or other metal dithionate salts.
9) Zinc electroplating systems based on electrolytes containing dithionic acid, zinc dithionate and/or other metal dithionate salts.
10) Precious metal (Au, Ag, Pt, Pd, Ru, Rh, Ir) electroplating, electroless plating or immersion plating electrolytes containing dithionic acid, precious metal dithionates and/or other metal dithionate salts.
11) In general, any metal finishing solution containing dithionic acid, nickel dithionate and/or other metal dithionate salts.

The benefits of using dithionic acid based compositions are derived from a number of factors.

Among these, one important factor is the high aqueous solubility of metal dithionate salts. The IIA metal salts of dithionic acid are very soluble in water, whilst the IIA metal salts of sulfuric acid are relatively insoluble in water. Thus, dithionic acid based electrolytes allow for the convenient addition of IIA metal salts, whilst sulfuric acid based electrolytes do not allow for such addition. The addition of IIA metal salts is sometimes required for extending the life of certain plating solutions, as in the addition of calcium salts to aged electroless nickel baths for the purpose removing by-product phosphite. The lead salt of dithionic acid is also soluble in water. Thus, dithionic acid can be used as the basis for Sn/Pb solder plating solutions. The lead salt of sulfuric acid is insoluble in water, and sulfuric acid can=t be used as the base electrolyte for Sn/Pb plating solutions.

Some other benefits of the present invention are summarized below:

1) Dithionic acid based electrolytes have been found to improve the quality of tin electrodeposits relative to comparable sulfate based systems.
2) Dithionic acid based electrolytes have been found to improve the throw of copper plating baths relative to comparable sulfate based systems.
3) Dithionic acid based electrolytes have been found to reduce the stress of nickel deposits relative to comparable sulfate based systems.
4) Metal surface cleaning solutions containing sodium dithionate have been found to have enhanced rust removing capability relative to solutions without the dithionate salt.

In a preferred embodiment, this invention covers metal finishing solution compositions which contain dithionic acid, metal dithionate salts and/or ammonium dithionate salts.

The components of the metal finishing solution other than the dithionic acid and/or metal dithionate salts and/or an ammonium dithionate salts may be changed as necessary to achieve optimal performance.

EXAMPLE 1

Preparation of Various Dithionate Salts and/or Dithionic Acid

1(a) Preparation of Manganese Dithionate

A jacketed 1 liter reactor was equipped with a mechanical stirrer, an addition funnel, a thermocouple thermometer and a gas inlet and outlet. The reactor was charged with 500 ml of DI water. The moderately stirred water was cooled by circulating a glycol cooling fluid through the external jacket until the water temperature was reduced to 10° C. The cooled water was saturated with gaseous $SO_2$ (1 g/min, 300 g total). Next, a slurry of manganese dioxide was created by mixing together 89 g $MnO_2$ (92% pure battery grade) and 50 g of DI water, and this slurry was slowly added (addition funnel) over about 1 hour to the aqueous $SO_2$. A continuous flow of $SO_2$(g) was maintained during the $MnO_2$ addition, and the temperature was maintained between 10° C. to 15° C. After the $MnO_2$ addition (solution usually becomes clear pink within 10 minutes), the $SO_2$(g) flow and the cooling was stopped. The excess $SO_2$ was removed by passing $N_2$(g) through the gently heated (app. 40° C.) solution over about 10 hours. Finally, a clear pink solution was obtained (82% yield of manganese dithionate by IC analysis based on $MnO_2$, 2%–3% sulfate impurity also by IC analysis).

1(b) Preparation of the Barium Dithionate.

To a vigorously stirred manganese dithionate solution (all of the solution from 1a) at room temperature was added over 20 minutes $Ba(OH)_2.8H_2O$ (290 grains) dissolved in 400 ml of DI water at 80° C. Vigorous stirring was maintained for about 3 hours. The white suspension was then filtered (note that the white manganese oxide collected in the filter turns brown and gummy when left in the air) to isolate pure aqueous barium dithionate (79% yield by IC analysis based on $MnO_2$).

1(c) Preparation of Copper Dithionate

A 2 liter flask was charged with an aqueous solution of barium dithionate (all of the solution from 1b) and an equimolar amount of solid $CuSO_4$ (a very concentrated aqueous solution can be used, addition with vigorous stirring). Vigorous stirring was maintained for about 3 hours following which time the white suspension of $BaSO_4$ was filtered. The resulting deep blue solution of copper dithionate was evaporated in-vacuo to yield solid copper dithionate as a blue crystalline material (approximately 55% yield based on $MnO_2$ with less than 0.8% sulfate impurity by IC analysis).

1(d) Preparation of Stannous Dithionate

Manganese dithionate and then barium dithionate as prepared as in Example 1(a) and 1(b).

A 2 liter flask equipped with a gas inlet/outlet was charged with an aqueous solution of barium dithionate, and a slow flow of nitrogen was initiated in order to purge the reactor of oxygen. An equimolar amount of solid $SnSO_4$ was added to the barium dithionate with vigorous stirring. The vigorous stirring and the nitrogen purge were maintained for about 3 hours following which time the white suspension of $BaSO_4$ was filtered. The clear solution of stannous dithionate obtained was usually used as is (evaporation in-vacuo led to excessive oxidation of $Sn^{+2}$ to $Sn^{+4}$) (approximately 57% yield based on the amount of $MnO_2$ originally used with less than 0.6% sulfate impurity by IC analysis).

1(e) Preparation of Mixed Dithionic Acid & Stannous Dithionate

A 2 liter flask equipped with a gas inlet and outlet was charged with an aqueous solution of barium dithionate (prepared as in Example 1b), and a slow flow of nitrogen was initiated. A 2 molar amount of solid $SnSO_4$ was added with vigorous stirring. The vigorous stirring and the nitrogen flow were maintained for about 1 hour, and then a ½ molar amount of sulfuric acid was added. The vigorous stirring and the nitrogen flow were maintained for another 2 hours after which time the white suspension of $BaSO_4$ was filtered. The clear filtrate of mixed dithionic acid and stannous dithionate was then used as is (approximately 70% yield with less than 1% sulfate impurity by IC analysis).

1(f) Preparation of Mixed Dithionic Acid & Cupric Dithionate

A 2 liter flask was charged with an aqueous solution of barium dithionate (prepared as in Example 1b) and a 2 molar amount of solid $CuSO_4$ with vigorous stirring. Stirring was continued for about 1 hour and then a 2 molar amount of sulfuric acid was added with continued vigorous stirring. Stirring was again maintained for about 2 hours following which time the white suspension of $BaSO_4$ was filtered. The clear blue solution of mixed dithionic acid and cupric dithionate was then used as is (approximately 50% yield based on the $MnO_2$ originally used with less than 1.5% sulfate impurity by IC analysis).

1(g) Preparation of Ammonium Dithionate

An aqueous solution of manganese dithionate (formed as in Example 1a) was treated with a 50% mole excess quantity of $(NH_4)_2CO_3$ added as an aqueous solution over about 20 minutes with vigorous stirring (take care to control $CO_2$ gas evolution during this step). Vigorous stirring was maintained for about 3 hours and then the white suspension was filtered (note that the solid manganese carbonate isolated in the filter slowly turns brown and gummy upon exposure to air). The clear ammonium dithionate solution isolated was evaporated in-vacuo to yield solid ammonium dithionate as a white crystalline material (95% yield based on the $MnO_2$ originally used with less than 1.6% sulfate impurity by IC analysis).

1(h) An Identical Procedure can be Used for the Preparation of bis(2-ammonium-2-methyl-1-propanol)dithionate. Bis(2-ammonium-2-methyl-1-propanol carbonate was Obtained by Saturating a Solution of 2-amino-2-methyl-1-propanol (AMP) with $CO_2$ Followed by the Addition of a Second Equivalent of AMP).

1(i) Preparation of Mixed Sodium/Magnesium Dithionate by Ion-Exchange

A jacketed glass reactor equipped with a source of $SO_2$ and a $N_2$(g) sparge was charged with 1 Kg of DI water. The water was cooled to 10° C. and then saturated with gaseous sulfur dioxide (required app. 200 g of $SO_2$). To the aqueous $SO_2$ solution, 160 grams of battery grade manganese dioxide (0.54 moles) was added over several hours such that the temperature remained between 10° C. and 15° C. The finely powdered $MnO_2$ reacted rapidly with a slight exotherm. Upon completion of the $MnO_2$ addition, the excess $SO_2$ was removed by heating the solution to 40° C. under a $N_2$(g) sparge for 8 hours. Next, an aqueous solution of sodium carbonate (57.6 grams, 0.54 moles) was added to the well stirred solution of manganese dithionate over 30 minutes. The precipitated manganese carbonate was removed by vacuum filtration through a 1 micron glass microfibre pad, and the aqueous sodium dithionate filtrate was collected. The filtrate was reduced in-vacuo to a solid. The product was isolated as the solid dihydrate in greater than 95% yield based on $MnO_2$. Next, a portion of the isolated sodium dithionate (23.4 grams, 97 mmol) was dissolved in 100 g of DI water, and to this approximately 1 M aqueous solution of sodium dithionate was added 50 grams of the proton form of Amberlyst 36W cation-exchange resin (app. 260 mmol of protons). The heterogenous mixture was stirred at RT for 10 minutes. The acidified aqueous dithionate solution was filtered free of the ion-exchange resin and then added to a beaker containing solid magnesium hydroxide (100 mmol). The suspension was stirred and gently heated for 1 hour. The solution was filtered free of solid material and then evaporated in-vacuo to yield 25 grains of a solid which by IC and ICP/emission analysis was 70.5% $S_2O_6^{-2}$, 0.7% $SO_4^{-2}$, 4.8% $Mg^{+2}$ and 6.6% $Na^+$.

EXAMPLE 2

Acid Tin Electroplating

Several formulations were tested, and results were compared through the analysis of electrodeposit quality (surface XRF and visual inspection). The formulations were prepared and used at room temperature. The electroplating experiments were performed in a 267 ml Hull Cell with bright brass plated steel panels and moderate mechanical agitation. The panels were pretreated by exposure to 40 ASF of cathodic current for two minutes in an alkaline phosphate solution at 60° C. followed by a 1 minute pickle in a solution of 5% MSA at RT. The electroplating current used was 1 A (2 minutes of plating=120 coulombs passed per experiment). The plated panels were washed with DI water and dried with hot air.

The formulations tested were:

a) The Ronastan TP acid tinplate system (Supplied by Shipley Ronal Corporation, Marlborough, Mass.) was used as a reference:
   - 15 g/l tin as Ronastan TP tin 300 concentrate (aqueous stannous methanesulfonate solution at 300 g/l as tin)
   - 30 ml/l Ronastan TP acid 70 (70% aqueous MSA)
   - 70 ml/l Ronastan TP-HCD Primary (a proprietary additive sold by Shipley Ronal (Marlborough, Mass.)
   - 15 ml/l Ronastan TP antioxidant (a proprietary additive sold by Shipley Ronal (Marlborough, Mass.)
   - 1.6 ml/l Ronastan TP-HCD secondary (a proprietary additive sold by Shipley Ronal (Marlborough, Mass.)

b) 15 g/l tin as Stannous Dithionate.
   - 30 ml/l Ronastan TP acid 70
   - 70 ml/l Ronastan TP-HCD Primary
   - 15 ml/l Ronastan TP antioxidant
   - 1.6 ml/l Ronastan TP-HCD secondary c) 15 g/l tin as Mixed Dithionic Acid & Stannous Dithionate. The Free Acidity of the Solution was 0.5 N.
   - 70 ml/l Ronastan TP-HCD Primary
   - 15 ml/l Ronastan TP antioxidant
   - 1.6 ml/l Ronastan TP-HCD secondary d) Formula A)+1 g/l Sodium Dithionate Visual analysis of the plated panels showed that formulas b), c) and d) allowed for an increased range of usable current density from 25-6 ASF to 30-2 ASF (47% improvement). XRF analysis of the plated panels revealed a 5% to 30% increase in electrodeposited tin thickness for the systems containing dithionate.

EXAMPLE 3

Acid Copper Electroplating

Several formulations were tested, and the results were compared through the analysis of electrodeposit quality (surface XRF and visual inspection). The formulations were prepared at room temperature and carbon treated. The electroplating experiments were performed in a 267 ml Hull Cell at RT with bright brass plated steel panels and moderate mechanical agitation. The panels were pre-treated by exposure to 40 ASF of cathodic current for two minutes in an alkaline phosphate solution at 60° C. followed by a 1 minute pickle in a solution of 5% MSA at RT. The electroplating current used was 3 A (100 seconds of plating=300 coulombs passed per experiment). The plated panels were washed with DI water and dried with hot air.

The formulations tested were:

a) Reference Formulation
   - 35 g/l copper as copper sulfate
   - 38.5 ml/l conc. sulfuric acid (96%)
   - 0.25 ml/l conc. HCl(aq)

b) Formulation a)+1 g/l ammonium dithionate c) Formulation a)+5 g/l ammonium dithionate d) 34 g/l copper as copper dithionate, 1N dithionic acid, 0.25 ml/l concentrated HCl Analysis of the plated panels showed that formulas b), c) and d) give the best results allowing for an increase in the range of usable current density from 90-6 ASF to 120-3 ASF (40% improvement). The addition of ammonium dithionate allowed for the average cell voltage to be decreased by about 3%.

EXAMPLE 4

Enhanced Throw in Dithionic Acid Based Acid Copper Plating Solutions

Two acid copper electroplating solutions were made up identically except for the exchange of cupric dithionate for cupric sulfate and the exchange of dithionic acid for sulfuric acid. The Techni Copper U system additive (supplied by Technic, Inc. of Cranston, R.I.) was employed. The formulations were made up as follows:

$[Cu^{+2}]$=24 g/L (A=cupric dithionate, B=cupric sulfate) as metal $[H^{+}]$=2N (A=dithionic acid, B=sulfuric acid)

$[Cl^{-}]$=50 ppm

Additive=0.5% v/v Technic Copper U Additive (a proprietary copper plating additive sold by Technic, Inc. of Cranston, R.I. as part of the Copper U Circuit Board Plating System).

Brass plated steel Hull Cell panels were electroplated (standard pre-treatment) with copper at 12 ASF (amps per square foot) for 28 minutes (exactly 675 coulombs of charge was passed in each case). The panels were plated in a rectangular cell with the cathode positioned parallel to the anode. The cathode piece fit flush into the cell with no spaces around the edge. The thickness of copper plated on the front and back of the cathode piece were compared. The results are tabulated below;

| | Cu thickness (microinches) | |
|---|---|---|
| Panel Side | Dithionic Acid | Sulfuric Acid |
| front | 205 | 290 |
| back | 70 | 50 |

The dithionic acid based copper electroplating solution had 67% better throw onto the back of the plated panel.

EXAMPLE 5

Nickel Electroplating

Several formulations were tested and the electroplating results were compared by visual inspection and by the analysis of electrodeposit stress using a deposit stress analyzer (1.2 $in^2$ copper stress strips). The formulations were operated at 60° C. and were pre-treated with activated carbon. The nickel plating system was the Atotech Sulfamate Nickel Process provided by Atotech, Inc. of Rock Hill, S.C. The electroplating experiments were performed in a 500 ml beaker at 50° C. with air agitation. Two nickel anodes were placed on both sides of the test strip at about 1 inch distance. The stress strip panels were first treated for two minutes in a solution of 50% conc. HCl(aq) at room temperature followed by a DI water rinse. The electroplating current was 0.8 A (1 minute of plating=60 coulombs passed per experiment). The plated strips were washed with DI water and dried with hot air.

The formulas tested were:

a) Reference formulation: Sulfamate nickel formulation 64 g/l Nickel as Nickel Sulfamate 6 g/l $NiCl_2$ 37.5 g/l Boric Acid 5 g/l SN-1 Addition Agent* (Atotech, Rock Hill, S.C.)

1.5 ml/l Antipit Y-17* (Atotech, Rock Hill, S.C.)

* Proprietary Ni plating additives sold by Atotech (Rock Hill, S.C.) as part of their Sulfamate Nickel Plating Process.

2) 64 g/l Nickel as Nickel Dithionate 6 g/l $NiCl_2$ 37.5 g/l Boric Acid 5 g/l SN-1 Addition Agent (Atotech, Rock Hill, S.C.)

1.5 ml/l Antipit Y-17 (Atotech, Rock Hill, S.C.)

The stress analysis showed that formulation b) relative to formulation a) allowed for both a reduction in the tensile stress of about 4% and a reduction in the cell voltage of about 6%.

EXAMPLE 6

Ferrous Alloy Cleaning

Aqueous solutions of ammonium sulfate and ammonium dithionate were compared for rust removal. Both solutions were prepared by dissolving 5 g of the corresponding salt in 100 ml of DI water at room temperature. Two identical pieces of rusted steel were prepared. One piece of rusted steel was submerged in the sulfate solution while the other piece was submerged in the dithionate solution. Rust removal was monitored as a function of time. The ammonium sulfate solution removes very little rust even after 4 days, while the aqueous dithionate Solution removes a significant amount of rust within one hour.

The invention claimed is:

1. A process for metal finishing comprising contacting the surface of a metallic part or material with a solution which contains 0.1% to 60% by weight of free ditbionic acid and at least 100 ppm of metal sulfate or ammuonium sulfate, wherein said metal finishing improves the mechanical, chemical or aesthetic properties of said metallic part or material.

2. The process of claim 1 wherein said solution further comprises at least 100 ppm of sulfuric acid.

3. A process for depositing a metal layer on the surface of a solid part or material comprising contacting said solid part or material with an electroplating solution composition comprising 0.1% to 60% by weight free dithionic acid and at least 100 ppm of metal sulfate or ammonium sulfate.

4. The process of claim 3 wherein said electroplating solution composition further comprises at least 100 ppm of sulfuric acid.

5. A process for depositing a metal layer on the surface of a solid part or material comprising contacting said solid part or material with an electroplating solution composition comprising dissolved metal dithionate or ammonium dithionate salts at a concentration of 0.1 molar or greater and at least 100 ppm of metal sulfate or ammonium sulfate.

6. A process for cleaning or activating the surface of a metallic part or material prior to another treatment process, storage or sale comprising contacting said metallic part or material with a surface cleaning solution composition comprising 0.1% to 60% by weight free dithionic acid and at least 100 ppm of metal sulfate or ammonium sulfate.

7. The process of claim 6 wherein said surface cleaning solution further comprises at least 100 ppm of sulfuric acid.

8. The process of claim 6 wherein said metallic part or material is a ferrous based alloy.

9. The process of claim 6 wherein said solution functions primarily as a rust removing agent.

10. A process for cleaning or activating the surface of a metallic material, other than copper, comprising contacting said metallic material with a surface cleaning or activating solution composition comprising dissolved metal dithionate or ammonium dithionate salts at concentrations of 0.1 molar or greater and at least 100 ppm of metal sulfate or ammoniumn sulfate.

11. The process of claim 10 wherein said metallic part or material is a ferrous based alloy.

12. The process of claim 10 wherein said solution functions primarily as a rust removing agent.

13. A process for depositing tin on a solid part or material through an electroless or immersion mechanism comprising contacting said solid part or material with a solution comprising 0.1% to 60% by weight free dithionic acid.

14. The process of claim 13 wherein said solution further comprises 100 ppm or more of suiftaric acid.

15. A process for depositing tin on a solid part or material through an electroless or immersion mechanism comprising contacting said solid part or material with a solution comprsing dissolved metal dithionate or ammonium dithionate salts at a concentration of 0.2M or greater and at least 100 ppm or more of metal sulfate or ammonium sulfate.

16. A process for depositing tin on a solid part or material through an electroless plating mechanism comprising contacting said solid part or material with a solution comprising dissolved ammonium dithionate salts at concentrations greater than 0.1M in metal.

* * * * *